US005746254A

United States Patent [19]

Janesky

[11] Patent Number: 5,746,254

[45] Date of Patent: May 5, 1998

[54] WATER-ESCAPE DEVICE FOR FREEZE-PRONE WATER CONDUIT

[76] Inventor: Lawrence Janesky, 11 Fawn Meadow La., Huntington, Conn. 06484

[21] Appl. No.: 658,119

[22] Filed: Jun. 4, 1996

[51] Int. Cl.[6] ..... E03B 7/10

[52] U.S. Cl. ..... 138/32; 138/27; 137/561 A

[58] Field of Search ..... 138/32, 27; 137/565, 137/561 A, 301; 4/679, 680, 668; 52/16, 12

[56] References Cited

U.S. PATENT DOCUMENTS

| | | | |
|---|---|---|---|
| 3,736,955 | 6/1973 | Schlesser | 137/561 A |
| 4,182,376 | 1/1980 | Nilsson | 137/561 A |
| 5,114,594 | 5/1992 | Rosebrock et al. | 137/561 A |
| 5,452,546 | 9/1995 | Goddard | 52/16 X |
| 5,533,303 | 7/1996 | Harvey | 52/16 |

*Primary Examiner*—Patrick Brinson
*Attorney, Agent, or Firm*—Perman & Green, LLP

[57] ABSTRACT

A water-escape conduit connector for use in the exterior above-ground vertical section of a water-discharge conduit having an interior vertical conduit segment communicating with a sump pump container or liner 14. The water-discharge conduit comprises an upstream segment, between the sump pump liner and the water-escape connector, and a downstream segment between the water-escape connector and the discharge or outlet end of the conduit. The novel water-escape device of the present invention is interposed in the water discharge conduit, at an exterior, above-ground location, to provide an emergency water outlet in the event that the downstream conduit segment becomes sealed against the free discharge of water therefrom.

2 Claims, 3 Drawing Sheets

WATER-ESCAPE DEVICE FOR FREEZE-PRONE WATER CONDUIT

BACKGROUND OF THE INVENTION

Field of the Invention

The present invention relates to water-evacuation systems, such as sump pump systems, which include a conduit through which water is pumped from beneath a basement floor, upwardly, out through or over an outside basement wall, and vertically downwardly through an exterior conduit into a subterranean conduit segment to a dry well or to downstream end thereof which opens at or below ground level.

Reference is made to my U.S. Pat. No. 5,314,313 for its disclosure of a basement water-control system incorporating a sump pump and a water-discharge conduit through which excess sub-terranean water is pumped vertically-upwardly, through or over the basement wall and vertically downwardly through an exterior conduit. In most cases the exterior conduit communicates with a conduit segment which extends below ground and drains at a downstream, down-grade location away from the basement of the home or other structure. The invention covered by my U.S. Pat. No. 5,314,313 includes means responsive to the accumulation of excessive amounts of water within the sump pump liner to activate an audible warning to alert the owner that the system is not discharging water as intended. One cause of such a malfunction can be a frozen or otherwise-plugged discharge conduit which prevents water discharge and can lead to a burned-out sump pump as the pump operates continuously in an attempt to reduce the water level.

The exterior water conduit can freeze and become plugged in sub-freezing climates due to water accumulation and freezing in sub-terranean portions thereof an/or in holes or ditches into which the conduit drains. The accumulation of excessive levels of sub-basement water causes the sump pump to operate continuously, while the discharge conduit is blocked by ice, until the pump burns out and stops or until the owner discovers the problem and deactivates the system.

SUMMARY OF THE INVENTION

The present invention relates to a water-escape device or conduit connector which is designed to be interposed as an above-ground segment of the vertical water discharge conduit of a basement water-control system, to permit the escape or discharge of water being pumped through an upstream segment of the conduit when the downstream segment of the conduit becomes plugged due to ice or other causes.

A preferred embodiment of the present invention relates to a water-escape device of the aforementioned type which is designed to prevent or minimize any escape or splattering of water therefrom during normal operation of the system, i.e., when the downstream segment of the water-discharge conduit is open to the free passage and discharge of water being pumped through the upstream segment of the conduit, such as by means of a basement sump pump.

A further preferred embodiment of this invention relates to a water-escape device of the aforementioned type which is designed to control the direction of escape of water therefrom, when the downstream conduit becomes plugged, whereby the water escaping from the above-ground segment of the conduit is directed radially-outwardly, away from the exterior wall of the foundation of the house or other building from which the water is being pumped.

THE DRAWINGS

DETAILED DESCRIPTION

Figure 1:
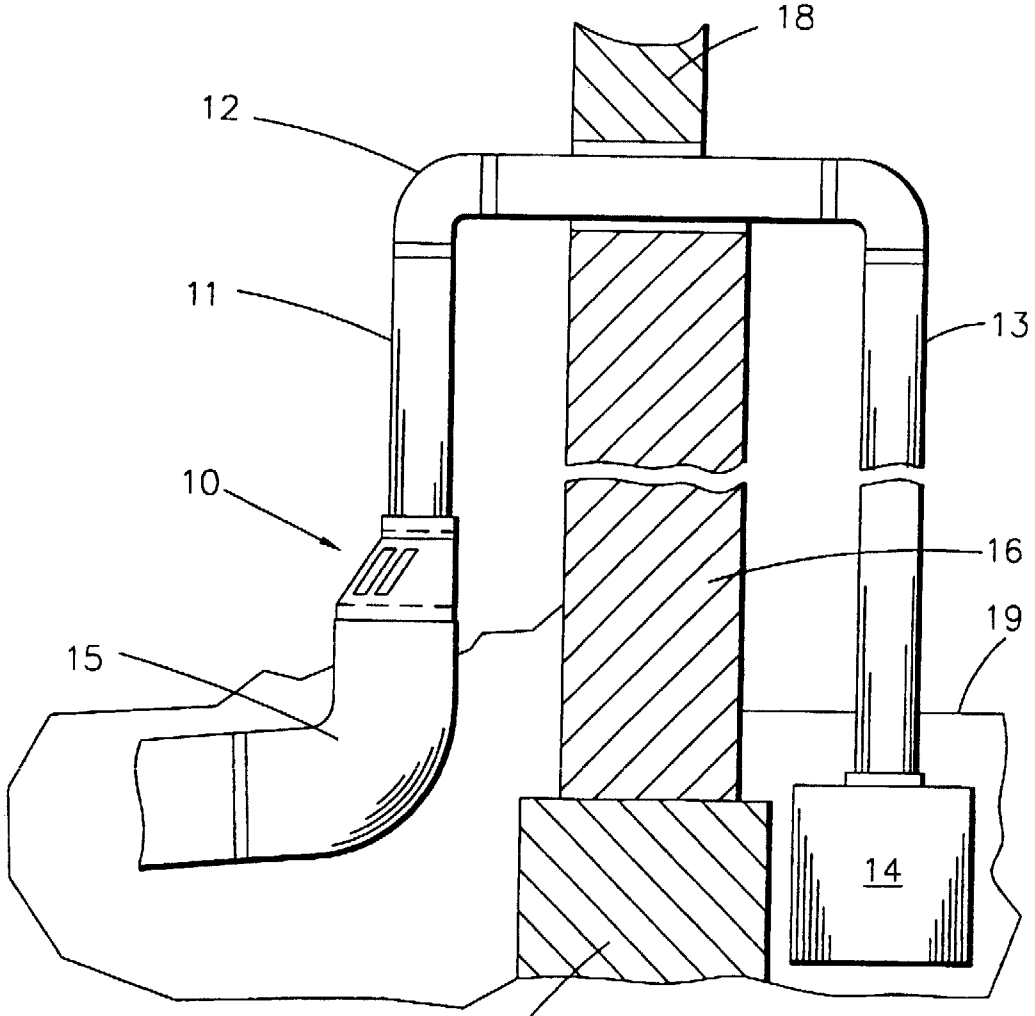
FIG. 1 is a fragmentary sectional view of a basement exterior wall and a basement water-evacuation conduit system incorporating a water-escape conduit segment or connector according to an embodiment of the present invention.

Referring to FIG. 1, the novel water-escape conduit connector 10 of the present invention is illustrated in operative position in the exterior above-ground vertical section 11 of a water-discharge conduit 12 having an interior vertical conduit segment 13 communicating with a sump pump container or liner 14. The water-discharge conduit 12 comprises an upstream segment, between the sump pump liner 14 and the water-escape connector 10, and a downstream segment 15 between the water-escape connector 10 and the discharge or outlet end of the conduit. Generally, the downstream conduit segment 15 extends below ground, as shown in FIG. 1, and opens at ground level or into a dry well.

In the basement water-control system illustrated by FIG. 1, a conventional basement wall 16 sits on a footing 17, and a wooden support beam 18 is present on the upper surface of the wall 16. A sump pump liner 14 is installed below the basement floor 19 to admit water which has leaked into the basement. A pump within the liner 14 is activated by a level-sensitive switch when the water rises to a redetermined level within the liner 14, to pump the water up and out through the conduit 12.

A critical problem is presented if the downstream water conduit segment 15 becomes blocked due to snow and/or ice accumulation within the conduit or at the discharge end thereof. This is a common problem in snowy and/or sub-freezing climates, and in installations where the discharge end of the conduit is located within a ground recess within which water can accumulate and freeze. In such cases, the sump pump operates in an effort to reduce the water level within the pump liner 14 but the water cannot escape from the conduit 12 and the pump can eventually burn out.

These problems are solved by the novel water-escape conduit connector device 10 of the present invention which is interposed in the water discharge conduit 12, at an exterior, above-ground location, to provide an emergency water outlet in the event that the downstream conduit segment 15 becomes sealed against the free discharge of water therefrom.

Figure 2:
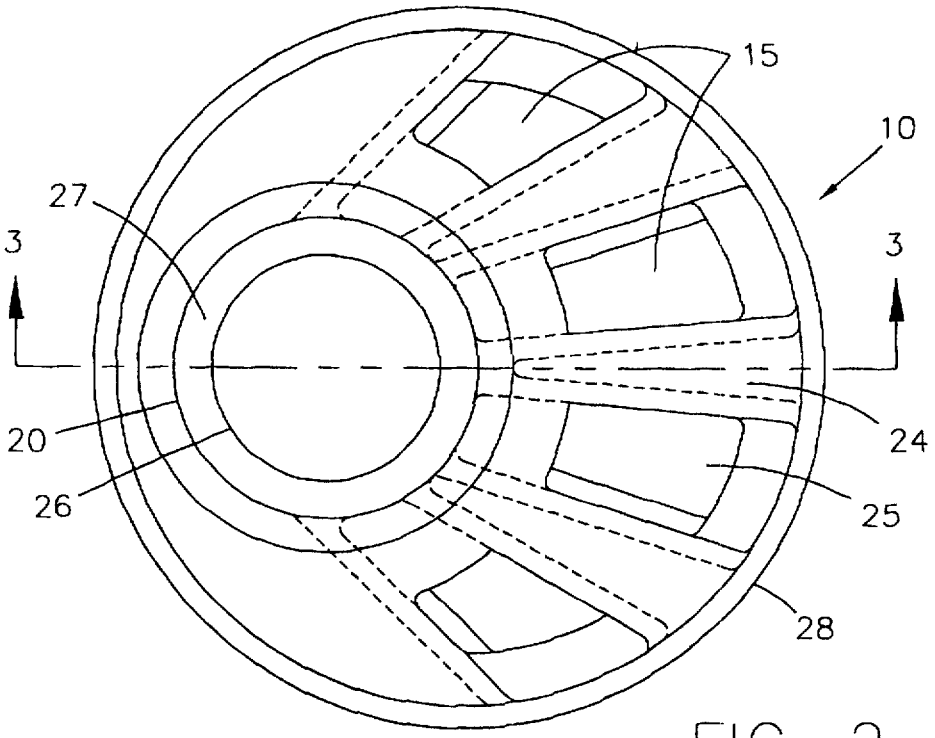
FIG. 2 is top view of a water-escape conduit segment or connector according to a preferred embodiment of the present invention.
Figure 3:
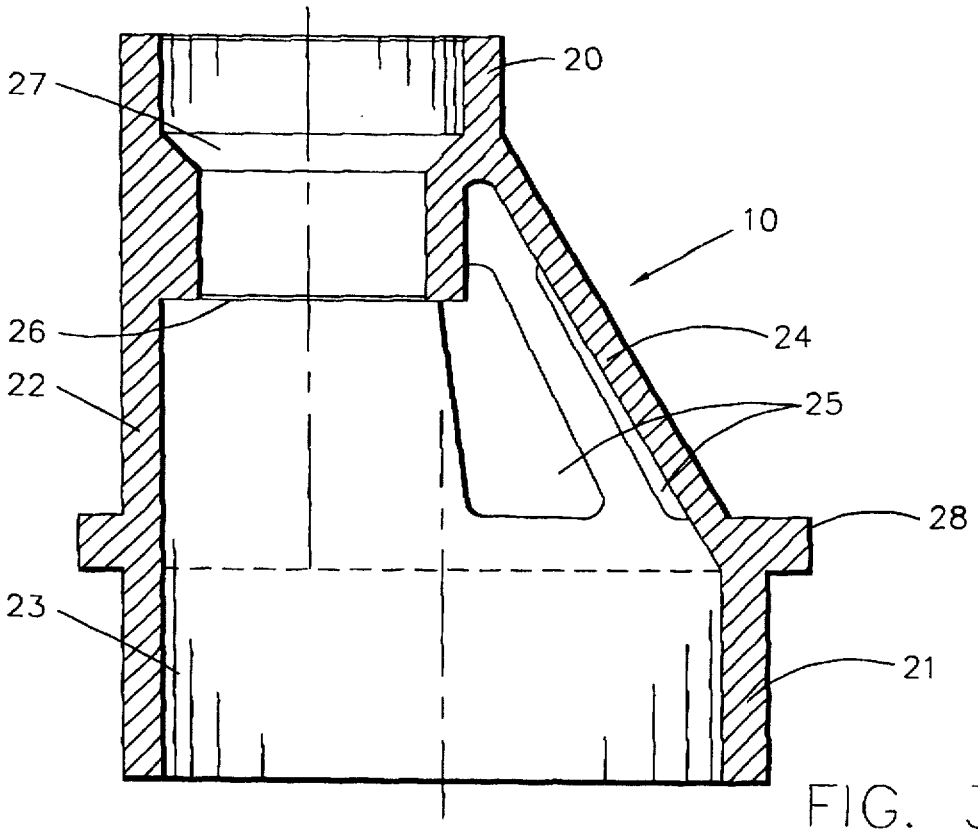
FIG. 3 is a side sectional view taken along the line 3—3 of FIG. 2.

In the embodiment illustrated by FIGS. 1 to 3 of the drawings, the water-escape conduit connector 10 functions as an adaptor between a smaller diameter upstream conduit section 11, such as PVC conduit having an outer diameter of 1⅞", and a larger diameter downstream conduit section 15, such as PVC conduit having an inner diameter of 4". This design reduces the opportunity for water escape during normal operation of the system when the downstream conduit segment 15 permits the free passage and discharge of water.

Referring to FIGS. 2 and 3, the device 10 thereof is a molded PVC conduit connector in the shape of an oblique truncated circular cone, having a small diameter water inlet neck 20 which is aligned with but offset relative to the center of a larger diameter water outlet neck 21, to provide a direct normal vertical water flow path therethrough which is adjacent a continuous vertical rearward segment 22 of the wall 23 of the device 10. The body of the device 10 tapers downwardly and outwardly from the cylindrical inlet neck 20 to the cylindrical outlet neck 21 to provide an oblique conical wall section 24 which tapers outwardly away from the continuous vertical rearward wall segment 22 and which is provided with a plurality of elongate water-discharge openings 25.

According to the preferred embodiment, the water inlet neck 20 of the connector device 10 has a reduced-diameter interior extension neck 26 which provides a stop member 27 for the inlet water conduit 12 and which extends a distance into the interior of the connector 10 to divert, direct or funnel the water flow from the conduit 12 downwardly along or adjacent the continuous wall 22, inwardly of and away from the oblique conical wall section 24 and out through the wide outlet neck 21, while avoiding any splattering of water out through the discharge openings 25 during normal operation. The outlet neck 21 is provided with an outer peripheral stop flange 28 which limits the extent of entry within the downstream conduit section 15. Thus, the outlet end of the tubular projection or interior extension neck 26, below the water inlet neck 20, is substantially smaller in diameter than the outlet neck 21 of the connector 10 to divert the water flow inwardly of and away from the escape opening(s) 25 in the tubular wall.

In the event of blockage of the conduit segment 15 downstream of the water-escape conduit connector 10, water will accumulate in and fill the downstream conduit segment 15, back up to the connector 10 and to the water-discharge openings 25 therein, from which water can escape. Thus any water being pumped from the pump liner 14 and up and out through the conduit section 13 upstream of the connector 10 will escape through the water-discharge openings 25 outwardly and away from the housing foundation 16 due to the location of the openings 25 in the front offset conical wall section 24 which tapers outwardly, away from the continuous rear vertical wall section 22. This protects the foundation 16 against discharge water, and directs the discharge water away from re-entry along the foundation.

The water-escape openings 25 are formed to be elongate in the vertical direction in order to preclude blockage by ice build-up within the connector 10 if water accumulates and freezes within the downstream conduit section 15, right up to the connector 10. Discharge water being pumped from the basement and sump liner 14 is always at a temperature well above freezing and will maintain the openings 25 open to the free escape of the discharge water.

Figure 4:
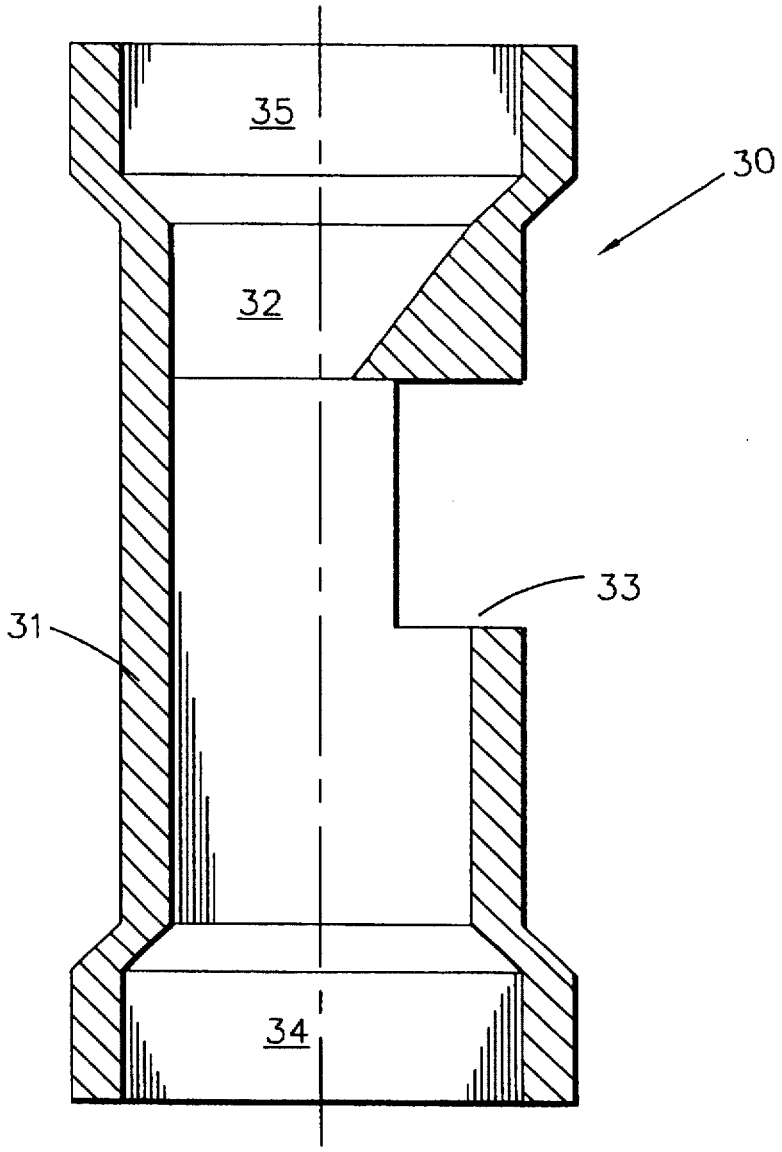
FIG. 4 is a side sectional view of a water escape conduit segment or connector according to another embodiment of the present invention.

While the water-escape conduit connector 10 illustrated by FIGS. 1–3 of the drawings represents a preferred embodiment of the present invention, it will be apparent to those skilled in the art that devices of other shapes and designs are also suitable for accomplishing the objective of the present invention. For example, the connector 30 shown in FIG. 4 is useful in situations where the downstream conduit section is already in place and has the same diameter as the upstream conduit section. The water-escape connector 30 comprises a uniform-diameter outer sleeve 31 having an upper internal funnel section 32 which directs the water discharge towards the center or towards the rear wall of the conduit, and having one or a plurality of vertically elongate water-escape openings 33 through the hemicylindrical front wall section facing away from the foundation. The outlet end 34 fits over the ground drain conduit and the inlet end 35 engages the outlet end of the basement drain conduit to provide a water escape conduit having openings 33.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A water-escape conduit connector which permits the direct flow of water from an upstream conduit through an inlet neck of said connector, vertically through said connector, and through an outlet neck of said connector having a diameter which is substantially larger than the diameter of said inlet neck, and through an open downstream conduit substantially without any leakage of water from said connector during normal operation, but which permits the free escape of water from said conduit connector radially-outwardly therefrom, at least in a predetermined direction, whenever the water is prevented from flowing freely through said downstream conduit, said conduit connector comprising a tubular element having said inlet neck adapted to be connected to the downstream end of an upstream water conduit, said tubular element having a tubular wall having a rear wall portion which extends vertically between said inlet and outlet necks, and an oblique front wall portion which tapers downwardly and outwardly from the inlet neck to the outlet neck of the connector, at least one escape opening being present as a vertically elongate opening in said oblique front wall portion, which permits the free escape of water from said connector only when water is prevented from flowing through the outlet neck and downstream conduit, the said inlet neck of said connector comprising an interior tubular projection which extends into the tubular element and is substantially smaller in diameter than the outlet neck of the connector to divert the water flow adjacent and parallel to said vertical rear wall portion of the connector, and through the outlet neck of the connector during normal operation when the water is free to flow directly vertically through the downstream conduit.

2. A water-escape conduit connector according to claim 1 in which said oblique front wall portion comprises a plurality of vertically-elongate water escape openings.

* * * * *